US006276856B1

(12) United States Patent
Pieper et al.

(10) Patent No.: US 6,276,856 B1
(45) Date of Patent: Aug. 21, 2001

(54) SELF CLEANING DIP-IN PACKAGE FOR LIQUIDS

(75) Inventors: Kathleen Ann Pieper, White Hall, MD (US); Richard Lawrence Horstman, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/229,129

(22) Filed: Jan. 12, 1999

(51) Int. Cl.[7] ..... A46B 11/00
(52) U.S. Cl. ..... 401/129; 401/122; 401/127
(58) Field of Search ..... 401/121, 122, 401/126–129

(56) References Cited

U.S. PATENT DOCUMENTS

| | | | | |
|---|---|---|---|---|
| 791,309 | * | 5/1905 | Young | 401/121 |
| 1,643,815 | | 9/1927 | Lesquendieu . | |
| 2,627,619 | | 2/1953 | Gagen | 15/121.3 |
| 2,733,722 | | 2/1956 | Rodd | 132/84 |
| 3,214,782 | | 11/1965 | Masters et al. | 15/521 |
| 3,469,928 | | 9/1969 | Widegren | 401/122 |
| 3,471,244 | | 10/1969 | Melocchi | 401/122 |
| 3,549,266 | | 12/1970 | Vasas | 401/122 |
| 3,756,731 | | 9/1973 | Aubry | 401/122 |
| 3,883,254 | | 5/1975 | Vasas | 401/122 |
| 3,891,330 | | 6/1975 | Vasas | 401/122 |
| 4,189,245 | | 2/1980 | Bennett | 401/126 |
| 4,403,624 | | 9/1983 | Montgomery | 132/88.7 |
| 4,572,224 | | 2/1986 | Rosenwinkel et al. | 132/88.5 |
| 4,609,300 | * | 9/1986 | Robert | 401/122 |
| 4,617,948 | | 10/1986 | Guéret | 132/88.5 |
| 4,671,689 | | 6/1987 | Gueret | 401/122 |
| 4,705,053 | | 11/1987 | Goncalves | 132/88.7 |
| 4,761,088 | | 8/1988 | Zubek | 401/122 |
| 4,780,017 | | 10/1988 | Bradford | 401/186 |
| 4,841,996 | | 6/1989 | Gueret | 132/320 |
| 4,927,281 | | 5/1990 | Gueret | 401/129 |

(List continued on next page.)

FOREIGN PATENT DOCUMENTS

| | | | |
|---|---|---|---|
| 454 374 | 6/1968 | (CH) . | |
| 37 04 496 C1 | 10/1987 | (DE) | B65D/51/32 |
| 88 03 737.1 | 5/1988 | (DE) | A45D/33/22 |
| 2.098.940 | 3/1972 | (FR) | A46B/11/00 |
| 2 745 272 | 8/1997 | (FR) | B65D/47/42 |
| 55-40085 | 9/1980 | (JP) . | |
| 57-153863 | 9/1982 | (JP) . | |
| 58-98010 | 7/1983 | (JP) . | |
| 59-39937 | 11/1984 | (JP) . | |
| 60-30204 | 9/1985 | (JP) . | |
| 63-17383 | 5/1988 | (JP) . | |
| 64-000822 | 1/1989 | (JP) . | |
| 1-18104 | 5/1989 | (JP) . | |
| 1-18105 | 5/1989 | (JP) . | |
| 1-18106 | 5/1989 | (JP) . | |
| 4-45625 | 10/1992 | (JP) . | |
| 6-4832 | 2/1994 | (JP) . | |
| 7-44248 | 10/1995 | (JP) . | |

*Primary Examiner*—Charles R. Eloshway
(74) *Attorney, Agent, or Firm*—Jack L. Oney, Jr.; Andrew A Paul

(57) ABSTRACT

A self cleaning dip in package is disclosed. The package includes a vial having an opening through which a user may access liquid stored within the vial. The opening is defined by an inner wall of the vial which provides access to the contents of the package. The package also includes an applicator adapted for insertion within the open end of the vial to access the liquid stored within the vial, wherein the applicator is coupled to a handle and the handle is selectively coupled to the vial for storing the liquid within the vial. The package further includes a first wiper coupled within the opening of the vial such that the applicator is wiped of excess liquid when the applicator is withdrawn from within the vial and a second wiper coupled to the handle such that the second wiper wipes the inner wall of the open end of the vial as the applicator is inserted into the vial. A process for filling the package and a venting system are also disclosed.

7 Claims, 6 Drawing Sheets

U.S. PATENT DOCUMENTS

| | | | |
|---|---|---|---|
| 4,929,108 | 5/1990 | Gueret | 401/126 |
| 4,960,339 | 10/1990 | Iizuka et al. | 401/129 |
| 5,054,946 | 10/1991 | Morel | 401/122 |
| 5,141,347 | 8/1992 | Fitjer | 401/126 |
| 5,201,809 | 4/1993 | Miura | 132/218 |
| 5,349,972 | 9/1994 | Dirksing et al. | 132/218 |
| 5,492,426 | 2/1996 | Gueret | 401/126 |
| 5,597,254 | 1/1997 | Vasas | 401/122 |
| 5,599,125 | 2/1997 | Vasas et al. | 401/122 |
| 5,636,931 | 6/1997 | Gueret | 401/126 |
| 5,775,386 | 7/1998 | Connan | 141/103 |
| 5,775,827 | 7/1998 | Packham et al. | 401/129 |
| 5,782,568 | 7/1998 | Röder et al. | 401/122 |
| 6,010,266 * | 1/2000 | Schrepf | 401/129 |
| 6,076,985 | 6/2000 | Gueret | 401/122 |

* cited by examiner

SELF CLEANING DIP-IN PACKAGE FOR LIQUIDS

FIELD OF THE INVENTION

The invention relates to a self cleaning dip-in package for liquids. More particularly, the invention relates to a self cleaning stem/wiper for dip-in cosmetic packages. The invention also relates to a process for filling a self cleaning dip-in package for liquids.

BACKGROUND OF THE INVENTION

Conventional lipsticks primarily consist of waxes, oils and pigments. The oils and waxes make the lipstick film fluid, allowing the lipstick to be easily blotted or rubbed off. Several "non-transfer" lipstick products have been recently introduced on the market. These products are similar in technology to conventional lipstick products, but replace the nonvolatile oils commonly found in conventional lipsticks with volatile solvents. As a result, the volatile solvent evaporates when the product is applied to the lips, leaving a drier film of waxes and pigments. The film resists blotting relative to oil-containing products, but dissolves readily in food oils.

These newer lipstick products employ a two-step lip coloring system that delivers a lipstick with noticeably longer-wearing color and a moist feel. The longer-wearing color is achieved via a pigmented solid polymer basecoat and the moist feel is achieved via a clear topcoat. In accordance with a preferred embodiment, the basecoat primarily consists of MQ resin and dimethicone gum, dissolved in a volatile permethyl 99A solvent that evaporates after the product is applied to the lips. Once the solvent evaporates, the pigments are adhered to the lips by a high viscosity polymer film that is free of waxes and oils. The end film is resistant to blotting, rubbing and food oils, all of which typically remove conventional lipsticks. However, the aggressive permethyl 99A volatile solvent dictates that a very good sealant system be employed in the application package.

The resins employed in the two-step lip coloring system are relatively expensive engineering grade resins, and containment of the resins is important. Containment of the resins is also important from an aesthetic standpoint since users do not wish to see excess resin dispersed around the inner neck of the vial when the brush or doe foot is removed from the vial. Prior attempts have been made to provide a wiper responding to the problems associated with the accumulation of excess resins on the inner neck of the vial. However, no wiper systems have effectively eliminated the problems in a convenient and cost effective manner.

Accordingly, a need exists for a package exhibiting excellent sealing and wiping characteristics. A need also exists for a convenient and reliable process for assembling and filling packages. The present invention provides a package exhibiting these characteristics, as well as a process for filling the packages.

SUMMARY OF THE INVENTION

It is, therefore, an object of the present invention to provide a self cleaning dip-in package. The package includes a vial having an opening through which a user may access liquid stored within the vial. The opening is defined by an inner wall of the vial which provides access to product stored within the package. The package further includes an applicator adapted for insertion within the open end of the vial to access liquid product stored within the vial, wherein the applicator is coupled to a handle and the handle is selectively coupled to the vial for storing the product within the vial. A first wiper is coupled within the opening of the vial such that the first wiper cleans excess product from the applicator as the applicator is withdrawn from within the vial. A second wiper is coupled to the handle such that the second wiper wipes the inner wall of the open end of the vial as the applicator is inserted into the vial.

It is also an object of the present invention to provide a package wherein the first wiper includes a check valve seal which engages the inner wall of the vial to allow the passage of product wiped by the second wiper into the vial but prevent the passage of product out of the vial.

It is another object of the present invention to provide a package including a stem insert which connects the applicator to the handle. In addition, the second wiper is integrally formed with the stem insert.

It is a further object of the present invention to provide a package wherein the stem insert includes vents which equalize pressure as the applicator is withdrawn from the vial to prevent the creation of vacuum pressure in the space between the first wiper and the stem insert as the applicator is withdrawn from the vial.

It is also an object of the present invention to provide a package wherein the vial includes an open second end sealed by a plug.

It is another object of the present invention to provide a package including at least one wiper vent allowing pressure to escape the vial once the applicator has been inserted within the vial such that the wiper vent contacts the first wiper creating a path through which pressure is released from the vial.

It is a further object of the present invention to provide a process for assembling and filling a package. The process includes the steps of coupling the top closure member to the open first end of the vial to seal the open first end of the vial, filling the vial with product through the open second end of the vial and securing the plug to the open second end of the vial to seal the open second end of the vial.

It is also an object of the present invention to provide a process for assembling and filling a package including the step of installing a wiper within the vial prior to coupling the top closure member to the vial.

It is another object of the present invention to provide a process for assembling and filling a package wherein the step of coupling the top closure member to the vial includes assembling the applicator and stem insert to form an applicator/stem insert assembly, installing the applicator/stem insert assembly within the open first end of the vial, and coupling the handle to the applicator/stem insert assembly.

It is a further object of the present invention to provide a wiper vent for a package. The wiper vent includes at least one passageway formed on the applicator/stem insert. The at least one passageway allows pressure to escape the vial once the applicator/stem insert assembly has been inserted within the vial such that the at least one passageway contacts the first wiper creating a path through which pressure is released from the vial.

It is also an object of the present invention to provide a wiper vent for a package wherein the applicator/stem insert assembly is formed from an applicator and a stem insert, and the at least one passageway is formed on the stem insert.

It is another object of the present invention to provide a wiper vent for a package including a plurality of passageways formed about the applicator stem insert.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

Figures 1, 2:
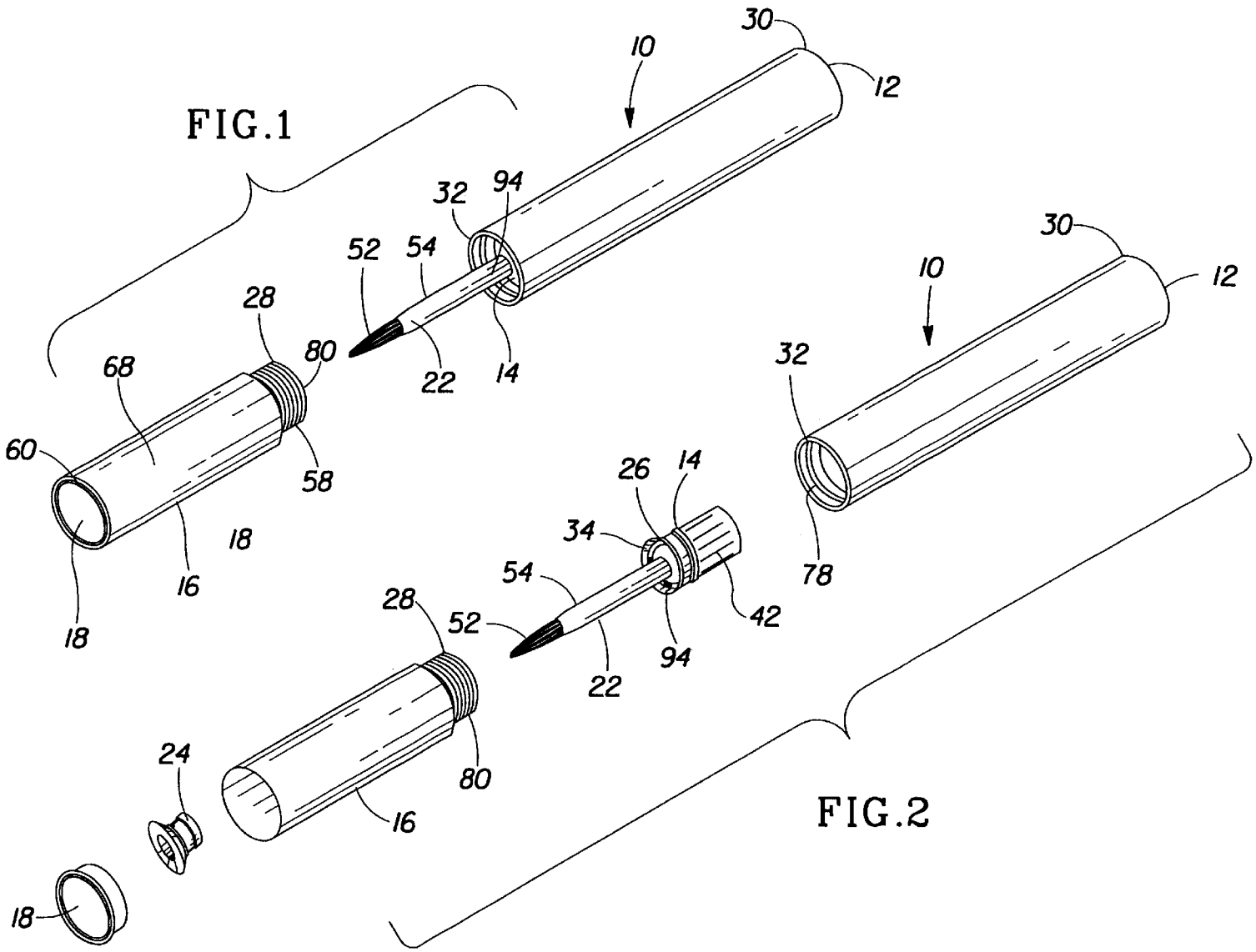
FIG. 1 is a perspective view of the present package with the vial and handle separated.
FIG. 2 is an exploded view of the present package with the plug assembled.

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

With reference to FIGS. 1–8, a self cleaning dip-in package 10 in accordance with the present invention is disclosed. The package 10 provides ideal sealing and wiping assemblies optimized for use with the two-step lip coloring systems discussed above. As such, the package 10 includes a handle 12, a stem insert 14, a vial 16, a bottom plug 18, a wiper system 20 and an applicator 22, 22'.

The preferred embodiment of the present package 10 has been designed with containment of the volatile lipstick product discussed above in mind. However, the package 10 may be used with other products without departing from the spirit of the present invention. When the package 10 is used with other products, variations in the package materials may be made without departing from the spirit of the present invention.

The present package 10 employs a dual wiper system 20 including an applicator wiper 24 and vial finish wiper 26. The wipers maintain a clean appearance on the applicator 22, 22' and vial finish 28. The package 10 further includes a series of vents which facilitate the efficient use of the present dual wiper system.

The handle 12 is shown in FIGS. 3, 4, 6 and 7, and is a substantially cylindrical member with a closed end 30 and an open end 32. The handle 12 is designed to support the applicator 22, for example, a brush 22 (see FIGS. 1 and 2) or doe foot 22' (see FIGS. 3 and 4), extending therefrom. In accordance with the preferred embodiment of the present invention, the handle 12 is manufactured from ABS, although the handle 12 may be manufactured from a variety of materials and with a variety of styles without departing from the spirit of the present invention.

A stem insert 14 is coupled within the open end 32 of the handle 12. The stem insert 14 includes an extended projection 34 to which the applicator 22, 22' is coupled. A vial finish wiper 26 is integrally molded with the stem insert 14. As will be discussed in greater detail below, the vial finish wiper 26 cleans the inside wall 40 of the vial finish 28 when the applicator 22 is inserted within the vial 16.

The stem insert 14 is preferably made from SELAR 3426, an amorphous nylon (polyamide) resin manufactured by DuPont. SELAR 3426 provides the barrier properties required for proper containment of the volatile lipstick product. Other similar materials, for example, CELCON (an acetal resin manufactured by BASF), polypropylene, etc., may be substituted without departing from the spirit of the present invention.

Figure 7:
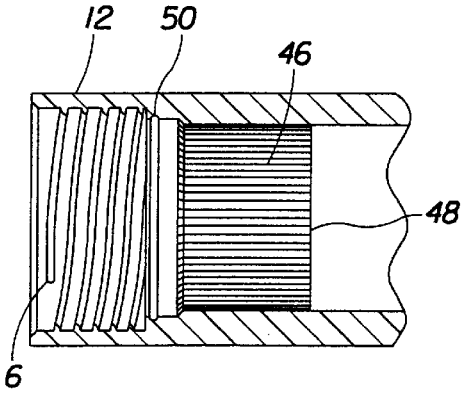
FIG. 7 is a cross-sectional view of the handle.

As discussed above, the stem insert 14 is secured within the open end 32 of the handle 12. The stem insert 14 and handle 12 are provided with engaging elements designed to securely maintain the stem insert 14 in position relative to the handle 12. Specifically, the outer surface of the stem insert 14 includes a plurality of longitudinally extending splines 42 and a snap bead 44. With reference to FIG. 7, the inner surface of the handle 12 includes a series of longitudinally extending grooves 46 shaped and, dimensioned to receive the plurality of longitudinally extending splines 42 and a mechanical stop 48 positioned at the upper end of the longitudinally extending grooves 46 shaped and dimensioned to limit longitudinal movement of the stem insert 14 within the handle 12. The inner surface of the handle 12 is further provided with a snap groove 50 shaped and dimensioned to securely receive the snap bead 44, and thereby retain the stem insert 14 in position with the handle 12.

In use, the stem insert 14 is inserted into the open end 32 of the handle 12. The longitudinally extending splines 42 first engage the longitudinally extending grooves 46 to ensure alignment of the stem insert 14 within the handle 12. The snap bead 44 then engages the snap groove 50. The final depth is achieved when the mechanical stop 48 is engaged upon seating the snap bead 44 in the snap groove 50. The longitudinally extending splines 42 ensure nonradial movement when applying torque, while the mechanical stop 48 and the snap bead 44 limit longitudinal movement of the stem insert 14 within the handle 12.

A variety of applicators may be used in accordance with the present invention. For example, and as shown in FIGS. 1 and 2, the applicator 22 may be a brush 52 held by a ferrule 54. The brush 52 is preferably shaped by the ferrule 54 to be oval in cross section at the base of the bristles. The bristle fibers are fine gauge (0.002"–0.004" in diameter) and gradually taper to a point at the tip of the brush 52 so that the fibers tend to converge on themselves. The oval cross-section of the ferrule 54 where the bristles emerge transitions to a round cross-section. The brush/ferrule subassembly attaches to the stem insert 14 in the region where the ferrule 54 is round in cross-section.

Figure 3:
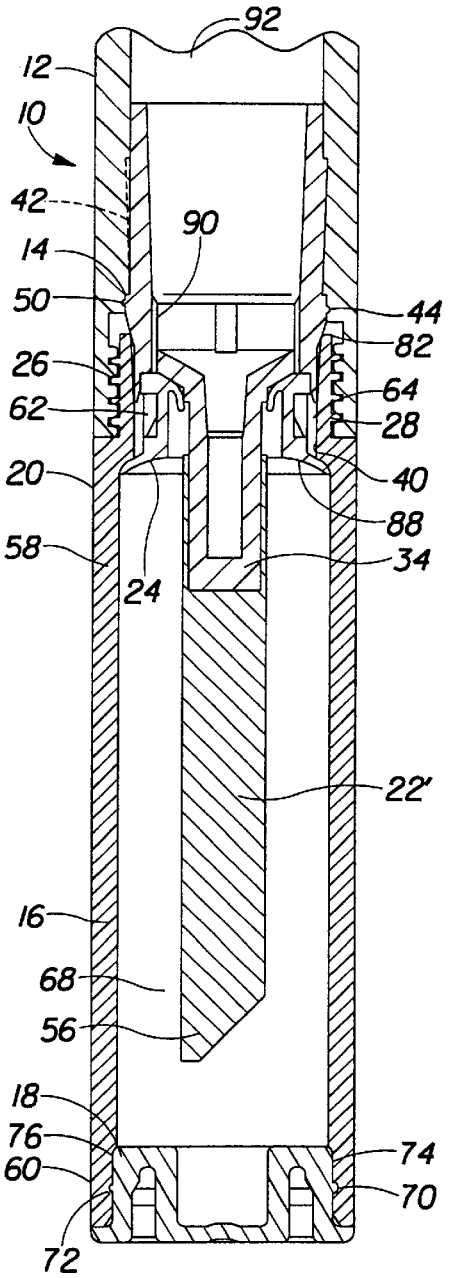
FIG. 3 is a cross-sectional view of the present package with the handle and vial connected.
Figure 4:
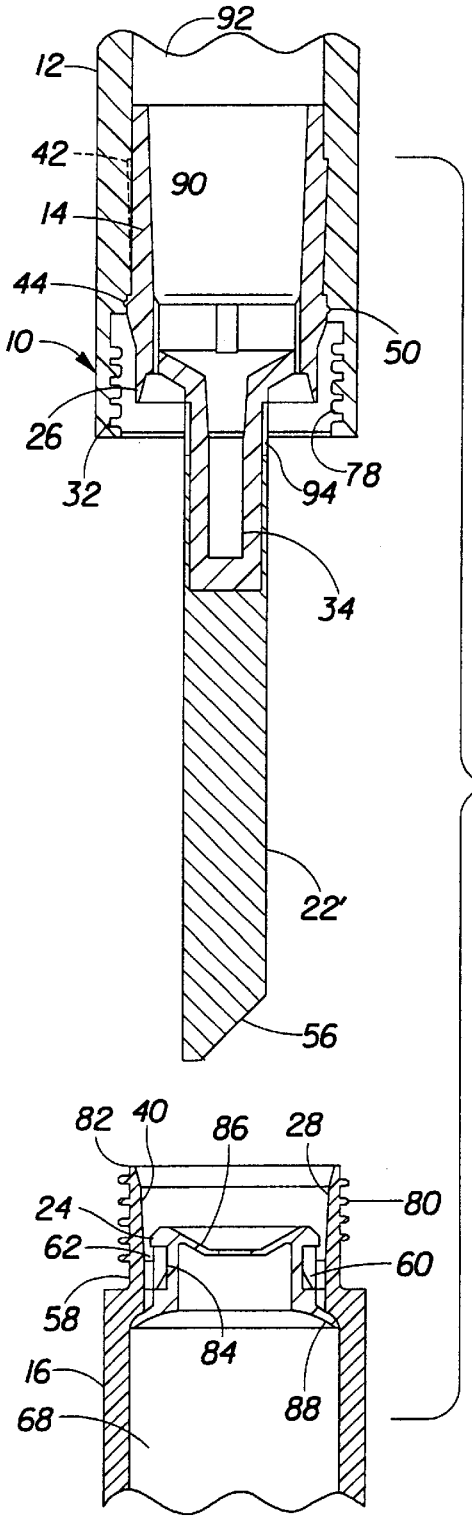
FIG. 4 is a cross-sectional view of the present package with the handle and vial separated.
Figure 5:
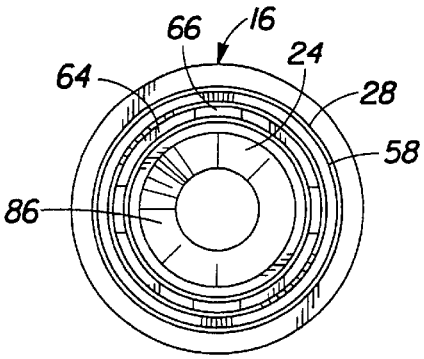
FIG. 5 is top view of the vial with the applicator wiper in position.
Figure 6:
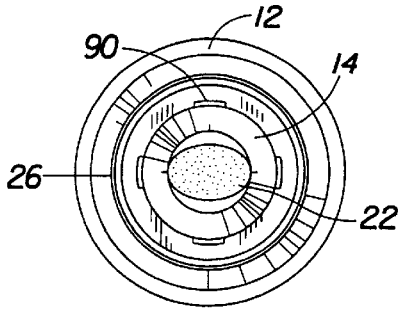
FIG. 6 is a bottom view of the handle with the stem insert in position.

Alternately, and as shown in FIGS. 3 and 4, the applicator 22' may take the form of a doe foot 56. The doe foot 56 consists of a white PVC flexor, urethane adhesive and flocking. The flocking is preferably 1.8 denier×0.030' long natural nylon flocking.

While two alternate embodiments of applicators have been disclosed above, it should readily be appreciated by those of ordinary skill in the art that a wide variety of applicators may be used without departing from the spirit of the present invention.

The vial 16 is shaped to substantially match the profile of the handle 12 and is accordingly a cylindrical shaped member. However, the vial 16 may take on a variety of other shapes without departing from the spirit of the present invention. The vial 16 includes open ends at both a first end 58 and a second end 60 thereof. The first end 58 of the vial 16 includes a vial finish 28 shaped and dimensioned to support the applicator wiper 24 (discussed in greater detail below) and receive the applicator 22 secured to the handle 12.

Specifically, the first end 58 of the vial 16 includes a centrally mounted ring 62 supported at the bottom of the vial finish 28. The ring 62 is supported by a series of support arms 64 creating an annular passageway 66 about the ring 62. The annular passageway 66 allows the vial finish wiper 26 to wipe excess product from the inner wall 40 of the vial finish 28 back into the product compartment 68 of the vial 16 in a manner that will be discussed below in greater detail. The ring 62 also supports the applicator wiper 24 such that the applicator 22 is wiped clean when the applicator 22 is pulled from within the vial 16.

The second end 60 of the vial 16 is open for filling in a manner that will be discussed in greater detail below. After filling, the second end 60 of the vial 16 is closed by a plug 18 which is inserted within the second end 60 of the vial 16. The plug 18 includes a snap bead 70 which engages a snap groove 72 along the inner wall 74 of the second end 60 of the vial 16. The plug 18 also includes a seal member 76 which engages the inner wall 74 of the vial 16 to form a seal between the vial 16 and the plug 18.

The vial 16 is preferably BAREX 210 injection molding material, an impact modified acrylonitrile-methyl acrylate copolymer manufactured by British Petroleum. BAREX 210 thoroughly contains the volatile lipstick product within the vial, although appropriate substitute materials may be employed without departing from the spirit of the present invention. The bottom plug 18 is preferably made from high density polyethylene. The plug 18 has the specific task of forming a hermetic seal with the vial 16. As such, fluorine gas treatments may be used to provide better product containment within the vial 16.

While a snap fit has been disclosed for securing the plug 18 within the second end 60 of the vial 16, other attachment methods could be used without departing from the spirit of the present invention. For example, the plug may be secured within the second end of the vial by sonic welding of like materials or by spin welding.

The handle 12 is selectively coupled to the vial 16 via the interaction between internal threading 78 formed adjacent the open end 32 of the handle 12 and external threading 80 formed on the vial finish 28. In this way the handle 12 is easily screwed onto the vial 16 to seal the opening found in the first end 58 of the vial 16.

As the handle 12 is screwed onto the vial finish 28, the stem insert 14 engages the inside top edge 82 of the vial finish 28 (see FIGS. 3 and 8) to securely seal the vial 16 and the contents held therein. The stem insert 14 is shaped and dimensioned to create a single contact point between the stem insert 14 and the inside top edge 82 of the vial finish 28.

As discussed in the Background of the Invention, it is important to maintain a clean appearance about the exposed areas of the package 10. As such, the package 10 is designed with a wiper system 20 consisting of an applicator wiper 24 mounted on the ring 62 supported within the first end 58 of the vial 16 (that is, within the vial finish 28) and a vial finish wiper 26 integrally formed with the stem insert 14. The wiper system 20 cleans product from the applicator 22 and the inner wall 40 of the vial finish 28.

The applicator wiper 24 contacts the applicator 22 to remove undesired product from the outer diameter of the applicator 22. The applicator wiper 24 also prevents liquid from flowing out of the vial 16 when the package 10 is inverted and the applicator 22 is positioned within applicator wiper 24.

As discussed above, the applicator wiper 24 is mounted on the ring 62 within the first end 58 of the vial 16. The applicator wiper 24 is substantially annular shaped and provides an access opening through which the applicator 22 may enter the vial 16. Specifically, the applicator wiper 24 includes a central circumferential rim 84 which seats about the ring 62 to mount the applicator wiper 24 within the first end 58 of the vial 16.

The applicator wiper 24 also includes an inner wiper member 86 substantially aligned with the opening formed in the ring 62. The inner wiper member 86 is angled toward the interior of the vial 16 to effectively wipe the applicator 22 as it is withdrawn from the vial 16.

The applicator wiper 24 is further provided with a check valve seal 88, or trumpet valve, about its outer circumference. The check valve seal 88 engages the inner wall 40 of the vial finish 28 below the support arms 64 connecting the ring 62 to the vial finish 64. The check valve seal 88 allows product accumulating on the vial finish 28 to be pushed back into the vial 16 while similarly preventing the same product from flowing along the wall of the vial 16 and out of the vial 16.

The applicator wiper 24 is preferably manufactured from nitrile rubber, although other materials may be used without departing from the spirit of the present invention. Nitrile rubbers are sufficiently flexible and maintain a small amount of dimensional change when submerged in the volatile lipstick product under load for extended periods of time. While nitrile rubbers have been specifically chosen for use with the present volatile lipstick composition because of their compatibility, the applicator wiper 24 may be made from a wide variety of materials so long as the wiper material is compatible with the liquid product stored within the vial 16.

The vial finish wiper 26 is integrally formed with the stem insert 14 and is substantially hidden from view. As such, the vial finish wiper 26 is formed from the same hard plastic material as the stem insert 14. The vial finish wiper 26 rubs against the inner wall 40 of the vial finish 28 when the handle 12 is inserted into and withdrawn from the vial 16. As such, the vial finish wiper 26 maintains the inner portion of the vial 16, specifically, the inner wall 40 of the vial finish 28, clean.

The stem insert 14 is vented 90 into the handle interior 92 to equalize pressure as the applicator 22 is inserted into the vial 16. By venting the stem insert 14 to the handle interior 92, the build up of negative pressure is prevented in the space between the applicator wiper 24 and the stem insert 14 when the applicator 22 is withdrawn from the vial 16. If the vents 90 were not present, a vacuum pressure would be created in the space between the applicator wiper 24 and the stem insert 14 as the applicator 22 is withdrawn from the vial 16. The vacuum pressure created by the withdrawal of the applicator 22 from the vial acts to pull lipstick product from the product compartment 68, through the inner wiper member 86 of the applicator wiper 24, and onto the applicator 22.

The stem insert 14 is further provided with wiper vents 94 located along a portion of the extended projection 34 of the stem insert 14 to which the applicator 22 is attached. The wiper vents 94 allow the vial 16 to vent any pressure built up while the applicator 22 is inserted into the vial 16. Specifically, pressure builds up within the vial 16 and the vial finish 28 as the applicator 22 is inserted therein. If the pressure is not vented, the pressure urges the handle 12 and the vial 16 apart.

The wiper vents 94 allow pressure to escape the vial 16 once the handle 12 has been inserted within the vial 16 and the wiper vents 94 contact the inner wiper member 86 of the applicator wiper 24. When the wiper vents 94 contact the inner wiper member 86, the wiper vents 94 create a path through which pressure is released from the vial 16.

In use, the handle 12 is twisted relative the vial 16 to release the handle 12 from the vial 16. Once the handle 12 is released, the applicator 22 may be withdrawn from the vial 16. As the applicator 22 is withdrawn from the vial 16, the inner wiper member 86 of the applicator wiper 24 contacts the applicator 22 to wipe off excess product. The excess product wiped from the applicator 22 is retained within the product compartment 68 of the vial 16. The user is then free to apply the product without worrying that excess product may drip from the applicator 22.

When the user is finished applying the product, the applicator 22 is inserted within the vial finish 28 and through the opening defined by the inner wiper member 86. The applicator 22 is inserted until the handle threads 78 engage the vial finish threads 80, at which time the handle 12 is rotated and secured to vial 16. While the threads of the handle and vial engage, the vial finish wiper 26 moves within the vial finish 28 and engages the inner wall 40 of the vial finish 28. The wiper 26 then moves along the wall 40 as the handle 12 and vial 16 are rotated. In this way, the vial finish wiper 26 pushes product which has accumulated on the inner wall 40 of the vial finish 28 back into the product compartment 68 of the vial 16. Specifically, the product is pushed along the inner wall 40 of the vial finish 28, through the annular passageway 66 created by the support arms 64, past the check valve seal 88 and into the product compartment 68 of the vial 16. Once the handle 12 is fully secured to the vial 16, the vial finish wiper 26 will have pushed excess product back into the product compartment 68 and a complete seal will have formed between the handle 12 and the vial 16.

Figure 8:
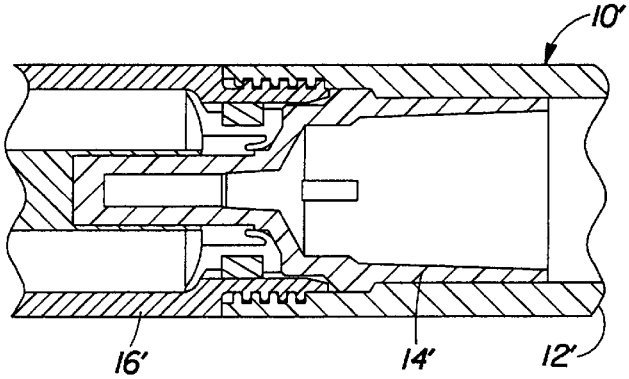
FIG. 8 is a cross-sectional view of a handle/stem insert without vents.
Figure 9:
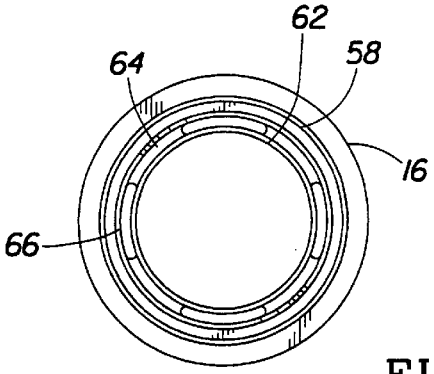
FIG. 9 is a top view of the vial without the applicator wiper.

In an alternate embodiment shown in FIG. 8, the stem insert 14' is not vented into the handle 12' to equalize pressure as the handle 12' is withdrawn from the vial 16'. As discussed above, the vents provided in the stem insert allow pressure to be vented as the handle is withdrawn from the vial. Such vents may be unnecessary for certain applications of the present package and additional manufacturing costs may be saved by not including the vents.

As discussed above, the materials used in the construction of the package 10 have been chosen based upon the volatile characteristics of the lipstick product packaged in accordance with the preferred embodiment of the present invention. As such, where the present package 10 is used to store other compositions, other materials may be used in the construction of the present package 10 without departing from the spirit of the present invention.

One way to ensure adequate sealing is by filling the basecoat through the bottom of the package 10 and plugging the bottom. This bottom filling is completed while the wiper system 20 is securely coupled to the top of the package 10. The bottom filling method is employed in contrast to more conventional techniques in which the package is filled through the top and the handle is subsequently inserted by hand.

Figure 10A:
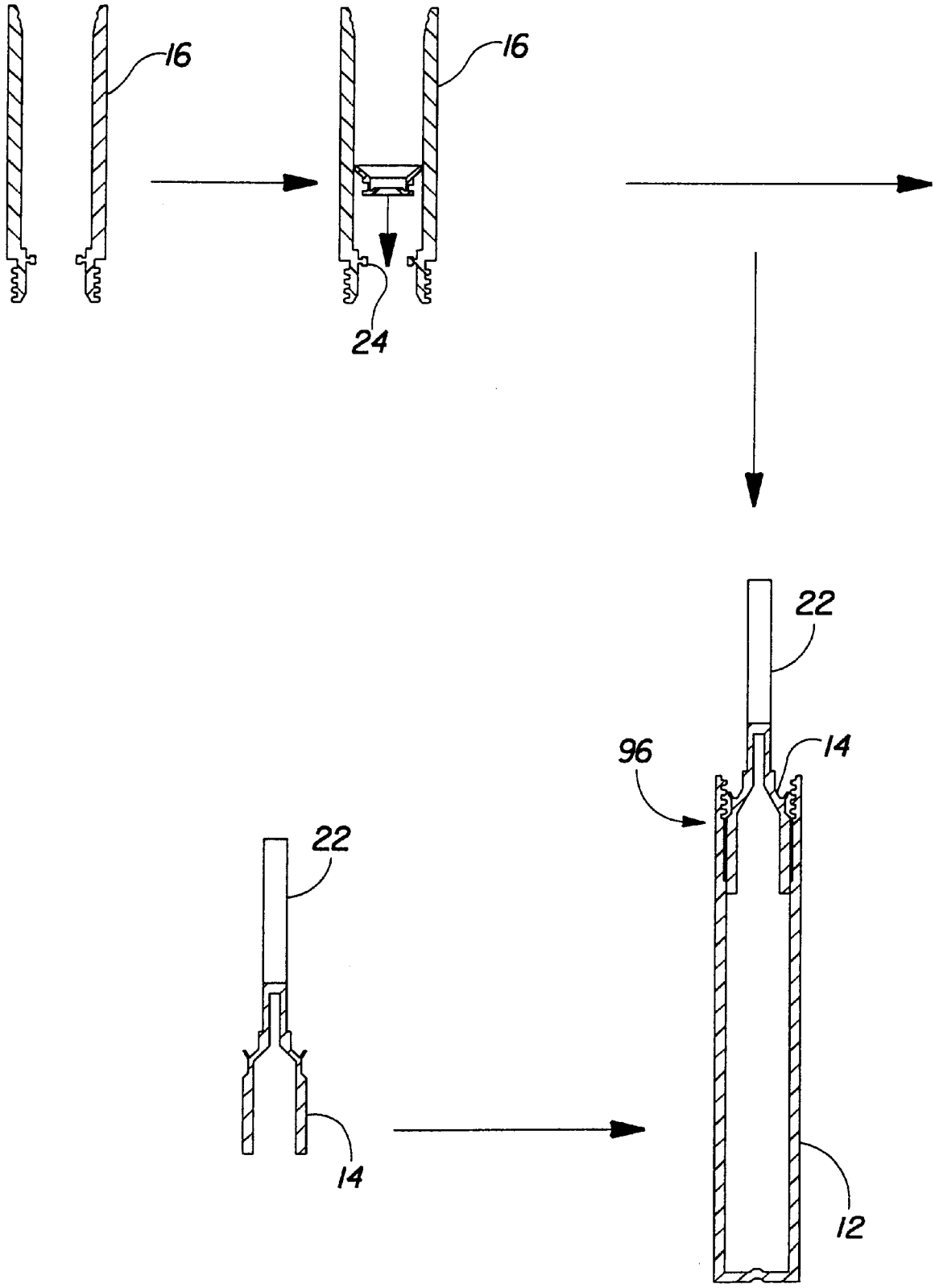
FIGS. 10A and 10B are schematics of the process for assembling and filling the present package.
Figure 10B:
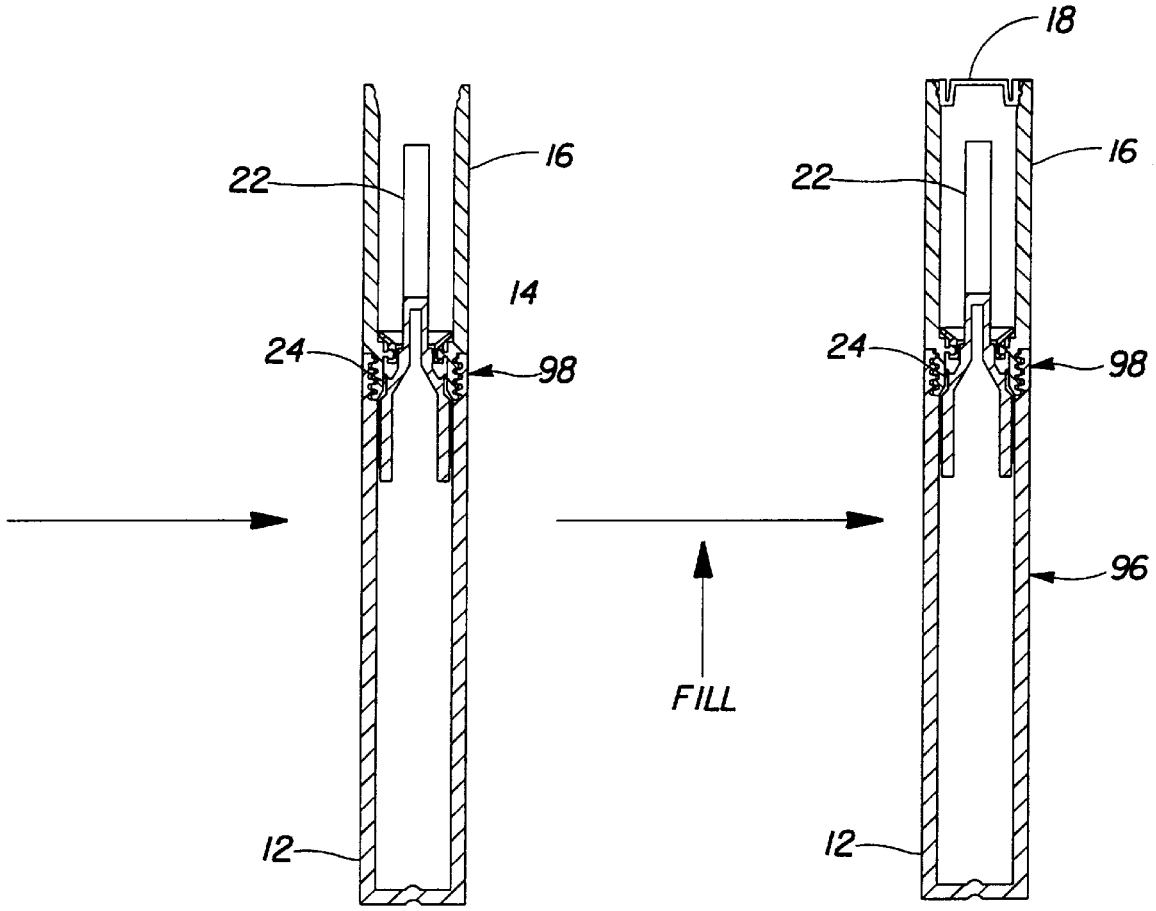

With reference to FIGS. 10A and 10B, the process for packaging product within the present package 10 is disclosed. As discussed above, the present process employs a bottom filling technique which optimizes the sealing characteristics of the container as well as the manufacturing costs of the packaged product.

The vial 16 is moved along an assembly line and the applicator wiper 24 is positioned within the vial finish 28 as discussed above. The handle assembly 96 is then assembled in the following manner.

The stem insert 14 and the applicator 22 are first connected. The handle 12 is then coupled to the stem insert/applicator assembly, completing the construction of the handle assembly 96.

Figure 11:
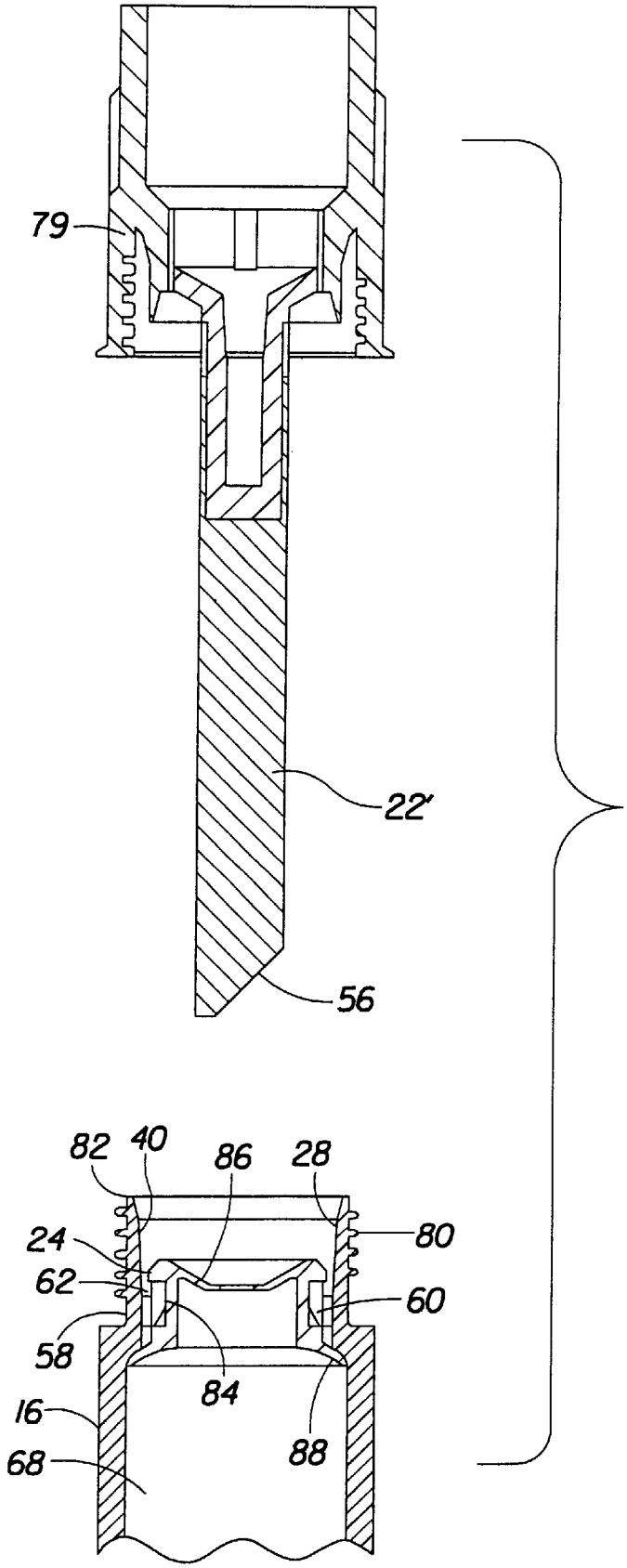
FIG. 11 is a cross-sectional view of the present package having an alternative mating design wherein the stem insert is extended and provided with threads which mate with the vial threads.

Once the handle assembly 96 is properly assembled, the handle assembly 96 is secured to the vial 16 by mating and rotating the handle threads 78 with vial threads 80. The functionality of mating handle threads 78 with vial threads 80 may be accomplished similarly in an alternative design by having stem insert 14 extend outside the outer surface of inner wall 40 and then providing threads on said stem insert extension 79 which mates with vial threads 80, as shown in FIG. 11, without departing from the spirit of the present invention. The handle/vial assembly 98 is then prepared for filling. The handle/vial assembly 98 is inverted (if it is not already inverted) and is filled with product. Finally, the plug 18 is snap fit to the bottom of the filled handle/vial assembly 98 and the packaged product is complete.

While the process discussed represents the preferred method for assembly of the package in accordance with the present invention, it is contemplated that similar packages may be assembled in accordance with the present process without departing from the spirit of the present invention. For example, where a vial finish wiper is not employed with the package, the stem insert/applicator assembly may be attached to the vial before the handle is secured to the stem insert/applicator assembly. When this takes place, the handle is coupled to the stem insert/applicator assembly after the stem insert/applicator assembly has been attached to the vial. Under such a variation, the preceding and subsequent steps discussed above would remain the same.

While the preferred embodiments have been shown and described, it will be understood that there is no intent to limit the invention by such disclosure, but rather, is intended to cover all modifications and alternate constructions falling within the spirit and scope of the invention as defined in the appended claims.

We claim:

1. A self cleaning dip-in package for liquids, comprising a handle, a stem insert, a vial, an applicator, and a wiper system:

(a) wherein the handle comprises a closed end and an open end, and wherein, except for its open end, the handle is of continuous construction such that its interior does not communicate with its exterior;

(b) wherein the stem insert is coupled to the open end of the handle; and wherein the stem insert includes a stem insert vent located in the stem insert which equalizes pressure as the applicator is withdrawn from the vial to prevent the creation of vacuum pressure in the space between the first wiper and the stem insert as the applicator is withdrawn from the vial, said stem insert vent venting into the handle interior, but not further venting to the exterior of the handle;

(c) wherein the vial includes an opening through which a user may access liquid stored within the vial, the opening being defined by an inner wall of the vial which provides access to product stored within the vial;

(d) wherein the applicator is adapted for insertion within the open end of the vial to access liquid product stored within the vial, wherein the applicator is coupled to the handle and the handle is selectively coupled to the vial for storing the product within the vial, whereupon said vial is then sealed by the handle coupled thereto;

(e) wherein the wiper system comprises:

(i) a first wiper coupled to the opening of the vial such that the first wiper cleans excess product from the applicator as the applicator is withdrawn from within the vial;

(ii) a second wiper coupled to the handle such that the second wiper wipes the inner wall of the vial at the open end of the vial as the applicator is inserted into the vial; and (iii) at least one wiper vent located along a portion of an extended projection of the stem insert to which the applicator is attached, allowing pressure to escape the vial once the applicator has been inserted within the vial such that the at least one wiper vent contacts the first wiper creating a path through which pressure is released from the vial into the handle interior, but not further to the handle exterior.

2. The package according to claim 1, wherein the vial includes a ring centrally mounted within the vial at the open end of the vial, wherein the first wiper is supported by the ring.

3. The package according to claim 1, wherein the first wiper includes a check valve seal which engages the inner wall of the vial to allow the passage of product wiped by the second wiper into the vial but prevent the passage of product out of the vial.

4. The package according to claim 1, wherein the second wiper is integrally formed with the stem insert.

5. The package according to claim 1, wherein the vial includes an open second end sealed by a plug.

6. The package according to claim 1, wherein the wiper vent comprises at least one annular passageway formed on the stem insert.

7. The package according to claim 6, wherein the annular passageways are grooves formed on the stem insert.

* * * * *